US006632487B1

(12) United States Patent
Arai et al.

(10) Patent No.: US 6,632,487 B1
(45) **Date of Patent: *Oct. 14, 2003**

(54) SHEET HAVING POWDER COATED THEREON, AND PRODUCTION AND USE THEREOF

(75) Inventors: Toshio Arai, Kobe (JP); Chikashi Sano, Kobe (JP); Kazuo Saitoh, Kobe (JP)

(73) Assignee: Bando Chemical Industries, Ltd., Hyogo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/423,220

(22) PCT Filed: Mar. 10, 1999

(86) PCT No.: PCT/JP99/01175

§ 371 (c)(1),
(2), (4) Date: Feb. 7, 2000

(87) PCT Pub. No.: WO99/46117

PCT Pub. Date: Sep. 16, 1999

(30) Foreign Application Priority Data

| | | |
|---|---|---|
| Mar. 12, 1998 | (JP) | 10-106861 |
| Jul. 24, 1998 | (JP) | 10-209902 |
| Feb. 10, 1999 | (JP) | 11-032547 |

(51) Int. Cl.[7] ..... B41M 5/00

(52) U.S. Cl. ..... 428/32.21; 428/32.25; 428/32.34

(58) Field of Search ..... 428/195, 323, 428/327, 329, 331, 341, 537.5, 32.21, 32.25, 32.34

(56) References Cited

U.S. PATENT DOCUMENTS

| | | | | | |
|---|---|---|---|---|---|
| 4,440,827 | A | * | 4/1984 | Miyamoto et al. | 428/327 |
| 4,460,637 | A | * | 7/1984 | Miyamoto et al. | 428/212 |
| 5,266,383 | A | * | 11/1993 | Sakaki et al. | 428/195 |
| 5,411,787 | A | * | 5/1995 | Kulkarni et al. | 428/195 |
| 5,576,088 | A | * | 11/1996 | Ogawa et al. | 428/327 |
| 5,591,294 | A | * | 1/1997 | Sakaki et al. | 156/250 |
| 5,647,935 | A | * | 7/1997 | Hoshino et al. | 156/231 |
| 5,919,559 | A | * | 7/1999 | Nakano et al. | 428/331 |
| 5,972,457 | A | * | 10/1999 | Matsuishi et al. | 428/64.1 |
| 6,001,463 | A | * | 12/1999 | Shibahara et al. | 428/216 |
| 6,357,871 | B1 | * | 3/2002 | Ashida et al. | 347/106 |
| 6,447,111 | B1 | * | 9/2002 | Gallo et al. | 347/101 |
| 6,461,726 | B1 | * | 10/2002 | Handa et al. | 428/327 |
| 6,492,006 | B1 | * | 12/2002 | Kapusniak et al. | 428/195 |
| 6,500,523 | B1 | * | 12/2002 | Hirose et al. | 428/195 |
| 6,506,478 | B1 | * | 1/2003 | Schulz | 428/195 |

FOREIGN PATENT DOCUMENTS

| | | |
|---|---|---|
| JP | 61-49883 | 3/1986 |
| JP | 2-43083 | 2/1990 |
| JP | 9-118068 | 5/1997 |
| JP | 10-278441 | 10/1998 |
| JP | 10-297116 | 11/1998 |
| JP | 10-297119 | 11/1998 |

* cited by examiner

*Primary Examiner*—Cynthia H. Kelly
*Assistant Examiner*—B. Shewareged
(74) *Attorney, Agent, or Firm*—Wenderoth, Lind & Ponack, LLP

(57) ABSTRACT

The invention provides a sheet coated with a powdery coating composition comprising a substrate and a porous and continuous resin layer provided on the substrate, the resin layer comprising particles of the powdery coating composition having an average particle diameter of 0.1 to 30 μm and inorganic fine particles having an average particle diameter of 1 nm to 1 μm and dispersed between the particles of powdery coating composition to form space at least in part therebetween. The sheet is suitably used as an image-receiving sheet for an ink-jet recording.

The sheet can be obtained according to the invention by mixing a powdery coating composition having an average particle diameter of 0.1 to 30 μm with inorganic fine particles having an average particle diameter of 1 nm to 1 μm to form a powdery mixture, dry-coating the powdery mixture on a substrate, melting the powdery coating composition by heating, and fixing the coating composition together with the inorganic fine particles on the substrate to form a resin layer comprised of the powdery coating composition.

11 Claims, 4 Drawing Sheets

SHEET HAVING POWDER COATED THEREON, AND PRODUCTION AND USE THEREOF

FIELD OF THE INVENTION

The present invention relates to a sheet coated with a powdery coating composition, and its production and use. More particularly, it relates to a sheet coated with a powdery coating composition, comprising a substrate and, a porous and continuous resin layer comprising particles of a powdery coating composition with space therebetween provided on the substrate, and its production and use particularly as an image-receiving sheet for a water based ink-jet recording.

DESCRIPTION OF PRIOR ART

Various recording systems have hitherto been known, and there has widely been used a water based ink-jet recording system for ejecting ink directly through a nozzle towards an image-receiving sheet, thereby to adhere ink and to record an image, recently.

This image-receiving sheet for a water based ink-jet recording has hitherto been formed by wet-coating a solution prepared by mixing a water-soluble or water-swelling resin, an inorganic pigment (such as silica) and other additives, on a substrate, drying the solution thereby to form a resin layer on the substrate, to disperse the inorganic pigment in the resin layer and to form a porous resin layer containing micropores therein. When the image-receiving sheet receives water based ink-jet ink, the ink is absorbed both in the micropores and resin thereby to form an image on the image-receiving sheet. In such way, a high-quality recording image could have hitherto been obtained by an ink-jet recording system using a specially prepared image-receiving sheet.

In such a specially prepared exclusive image-receiving sheet, however, an ink-receiving layer is formed by wet-coating a resin and other additives on a substrate, and hence, an environmental consideration is required on removal of the solvent. Furthermore, the resin to be used is limited as described above and the resulting image-receiving sheet is expensive because of many production processes and the use of an organic solvent.

The present inventors have intensively researched the production of an image-receiving sheet for an ink-jet recording by dry-coating of a powdery coating composition, not wet-coating. As a result, they have found that, it is possible to form, on a substrate, a porous and continuous resin layer comprising particles of a powdery coating composition and inorganic fine particles dispersed between the particles to form space at least in part between the particles of the powdery coating composition so that the particles of the powdery coating composition are apparently isolated at least in part from each other by the inorganic fine particles by mixing the powdery coating composition with the inorganic fine particles in a predetermined ratio to form a powdery mixture, coating the powdery mixture on the substrate, melting the coated powdery mixture by heating and fixing it.

The present inventors have found that such an image-receiving sheet for an ink-jet recording having a resin layer as an ink-receiving layer can be produced simply at low cost by using any resin with no restriction. Moreover, such an image-receiving sheet for an ink-jet recording is superior in permeability and absorbency of jet printing ink and a clear image having high density is formed by the image-receiving sheet for an ink-jet recording, thereby making it possible to obtain a high quality ink-jet recording image. Thus, the present invention has been accomplished.

Therefore, it is an object of the present invention to provide a sheet coated with a powdery coating composition whose resin layer on a substrate has a specific structure, a method for the production and use thereof, particularly an image-receiving sheet for an ink-jet recording.

Furthermore, the present inventors have found that it is possible to obtain an image-receiving sheet for an ink-jet recording, capable of forming a clearer and more accurate image having higher density, by forming on a substrate a porous and continuous resin layer composed of particles of a powdery coating composition and a first inorganic fine particles dispersed between the particles to form space at least in part between the particles of the powdery coating composition, and further forming a surface layer composed of a second inorganic fine particles on the resin layer. Thus, the present invention has been accomplished.

It is a further object of the invention, therefore, to provide an image-receiving sheet for an ink-jet recording, capable of forming a clear and accurate image having high density, which comprises a substrate and, a porous and continuous resin layer provided on the substrate, the resin layer comprising particles of a powdery coating composition and a first inorganic fine particles dispersed between the particles and forming space at least in part between the particles of the powdery coating composition, the sheet further comprising a surface layer comprising a second inorganic fine particles on the resin layer, and its production.

SUMMARY OF THE INVENTION

According to the present invention, there is provided a sheet coated with a powdery coating composition, comprising a substrate and a porous and continuous resin layer provided on the substrate, the resin layer comprising particles of the powdery coating composition having an average particle diameter of 0.1 to 30 $\mu$m and inorganic fine particles having an average particle diameter of 1 nm to 1 $\mu$m dispersed between the particles of the powdery coating composition and forming space at least in part between the particles of the powdery coating composition.

Such a sheet coated with a powdery coating composition of the invention can be suitably used as an image-receiving sheet for an ink-jet recording.

Such a sheet coated with a powdery coating composition can be obtained by mixing a powdery coating composition having an average particle diameter of 0.1 to 30 $\mu$m with inorganic fine particles having an average particle diameter of 1 nm to 1 $\mu$m to form a powdery mixture, dry-coating the powdery mixture on a substrate, melting the powdery coating composition by heating, and fixing the melted powdery coating composition on the substrate together with the inorganic fine particles to form a resin layer having at least in part space between the particles of the powdery coating composition, in accordance with the invention.

Further according to the invention, there is provided an image-receiving sheet for an ink-jet recording, comprising a resin layer having a thickness of 1 to 100 $\mu$m and a surface layer comprising inorganic fine particles having an average particle diameter of 1 to 50 nm formed on the resin layer, the resin layer comprising particles of a powdery coating composition having an average particle diameter of 0.1 to 30 $\mu$m and containing a resin and a colorant.

Such an image-receiving sheet for an ink-jet recording can be obtained by a method comprising the steps of dry-coating particles of a powdery coating composition having an average particle diameter of 0.1 to 30 μm and containing a resin and a colorant, on a substrate to form a resin layer, forming a surface layer comprising inorganic fine particles having an average particle diameter of 1 to 50 nm on the resin layer, fixing the resin layer on the substrate, and fixing the surface layer on the resin layer.

Particularly, a preferred image-receiving sheet for an ink-jet recording according to the invention comprises a substrate and, a porous and continuous resin layer provided on the substrate, the resin layer comprising particles of a powdery coating composition having an average particle diameter of 0.1 to 30 μm and containing a resin and a colorant, and a first inorganic fine particles having an average particle diameter of 1 nm to 1 μm dispersed between the particles of the powdery coating composition to form at least in part space therebetween, the sheet further comprising a surface layer comprising a second inorganic fine particles having an average particle diameter of 1 to 50 nm on the resin layer.

Such an image-receiving sheet for an ink-jet recording can be obtained by mixing a powdery coating composition having an average particle diameter of 0.1 to 30 μm, which contains a resin and a colorant, with a first inorganic fine particles having an average particle diameter of 1 nm to 1 μm to form a powdery mixture, dry-coating the powdery mixture on a substrate to form a resin layer, and forming a surface layer comprising a second inorganic fine particles on the resin layer.

DESCRIPTION OF THE PREFERRED EMBODIMENTS

Figure 1:
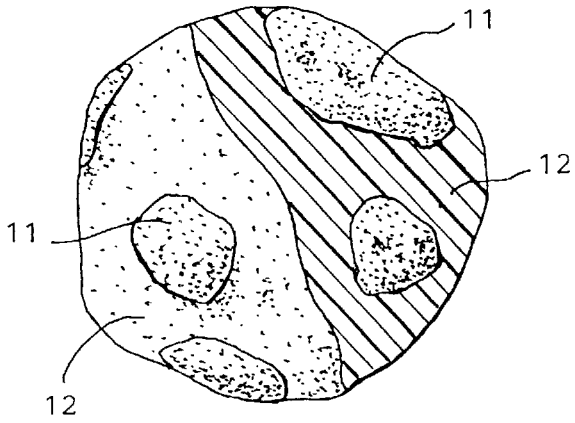
FIG. 1 is a partially sectioned perspective view showing schematically one embodiment of a powdery coating composition used in the invention.

The sheet coated with a powdery coating composition according to the invention comprises a substrate and, a porous and continuous resin layer provided on the substrate, the resin layer comprising particles of a powdery coating composition having an average particle diameter (average value of primary particle diameter, the same rule applies correspondingly to the following) of 0.1 to 30 μm and inorganic fine particles having an average particle diameter (average value of primary particle diameter, the same rule applies correspondingly to the following) of 1 nm to 1 μm dispersed between the particles of powdery coating composition to form space at least in part therebetween.

First, the production of the sheet coated with a powdery coating composition of the invention will be described.

The sheet can be obtained by mixing a powdery coating composition having an average particle diameter of 0.1 to 30 μm, preferably 1 to 25 μm, with inorganic fine particles having an average particle diameter of 1 nm to 1 μm to form a powdery mixture, dry-coating the powdery mixture on a substrate, melting the powdery coating composition by heating and fixing the melted powdery coating composition together with the inorganic fine particles on the substrate thereby forming a porous and continuous resin layer on the substrate comprising the particles of powdery coating composition and the inorganic fine particles dispersed between the particles of powdery coating composition to form space at least in part therebetween.

According to the invention, as described above, the inorganic fine particles are adhered on the surface of particles of the powdery coating composition by mixing the powdery coating composition with the inorganic fine particles, thereby making it possible to obtain a powdery mixture wherein the surface of the particles of the powdery coating composition is coated with the inorganic fine particles.

Paper, synthetic paper and synthetic resin sheets can be preferably used as a substrate. If necessary, a substrate made of metal is also used. Paper is not specifically limited as far as it is made of normal cellulose fibers, and includes wood free paper and coated paper, in addition to ordinary paper. The ordinary paper includes, for example, normal PPC copying paper, those which are subjected to a calendering treatment to enhance the surface smoothness of the PPC copying paper, and word processor paper for heat transfer and coated paper, which has already been surface-treated.

The synthetic resin paper includes, for example, sheets made of polyester, polyvinyl chloride, polyethylene, polypropylene, polyethylene terephthalate, polycarbonate and polyamide. The synthetic paper includes, for example, those prepared by mixing a polyolefin resin or another synthetic resin as a resin component with inorganic fillers, followed by extrusion molding of the mixture.

By using paper as the substrate, the sheet coated with a powdery coating composition and image-receiving sheet for an ink-jet recording of the invention can be produced at low cost.

The sheet coated with a powdery coating composition according to the invention can be used as an image-receiving sheet for an ink-jet recording comprising the above resin layer as a receiving layer for jet printing ink, that is particularly suitable.

The powdery coating composition used in the invention contains a resin. This resin serves as a binding resin capable of integrating various components of the powdery coating composition into a powder, and also forms a resin layer as a receiving layer for jet printing-ink on a substrate, as described above, and supports a colorant such as a dye or pigment constituting a letter or an image on recording of the letter or image due to jet printing ink, thereby making it possible to record it on a receiving sheet.

According to the invention, the resin constituting the powdery coating composition is not specifically limited, and there can be used hydrophobic resin, hydrophilic resin including water-absorbing resin and water-soluble resin, and a mixture thereof. The mixture of these resins may be a mixture of two or more kinds of resin particles, e.g. a mixture of hydrophobic resin particles and water-absorbing resin particles or hydrophilic resin particles, or a composite prepared by melt-kneading two or more kinds of resins, e.g. hydrophobic resin particles and water-absorbing resin or water-soluble resin particles, followed by cooling, grinding and further classification of the mixture, as described below.

The hydrophobic resin refers to those wherein the absorption amount of deionized water is 0.1 times or less, preferably 0.01 times or less, as much as its own weight. Specific examples thereof include styrenic resin such as saturated polyester resin, polyamide resin, (meth)acrylic resin, polyurethane resin, polyvinyl acetal resin, vinyl chloride resin, vinyl acetate resin, vinyl chloride-vinyl acetate copolymer resin, vinylidene chloride resin, polystyrene resin, styrene-acrylic copolymer resin, styrene-butadiene copolymer resin, etc.; polyoelfinic resin such as polyethylene resin, ethylene-propylene copolymer resin, ethylene-vinyl acetate copolymer resin, polypropylene, etc.; and epoxy resin.

The above saturated polyester resin is a polymer obtained by condensation polymerization of a dihydric carboxylic acid and a dihydric alcohol. The dihydric carboxylic acid is not specifically limited and includes, for example, aliphatic dibasic acid such as malonic acid, succinic acid, glutaric acid, adipic acid, sebacic acid, hexahydrophthalic anhydride, etc.; and aromatic dibasic acid such as phthalic anhydride, phthalic acid, terephthalic acid, isophthalic acid, etc. If necessary, a polybasic acid (tribasic or more) may also be used in combination. The polybasic acid includes, for example, trimellitic anhydride and pyromellitic anhydride.

Also the dihydric alcohol is not specifically limited and includes, for example, ethylene glycol, propylene glycol, butylene glycol, hexanediol, neopentyl glycol, diethylene glycol, dipropylene glycol, hydrogenated bisphenol A. If necessary, a polyhydric alcohol (trihydric or more) may also be used in combination. The polyhydric alcohol includes, for example, glycerin, trimethylolpropane, diglycerin, pentaerythritol and sorbitol.

A commercially available product can be suitably used as the unsaturated polyester resin. The commercially available product includes, for example, Bailon 103, 200, 290, 600 (manufactured by Toyobo Co.); KA-1038C (manufactured by Arakawa Chemical Co.); TP-220, 235 (Nippon Synthetic Chemical Industry Co.); Diaculon ER-101, ER-501, FC-172, FC-344, FC-714 (manufactured by Mitsubishi Rayon Co.); and Tafuton NE-382, 1110, 2155 (manufactured by Kao Corp.).

The styrene-acrylic copolymer resin is a copolymer of styrene and (meth)acrylate and specific examples of the (meth)acrylate includes ethyl acrylate, butyl acrylate, methyl methacrylate, ethyl methacrylate, butyl methacrylate, 2-ethylhexyl methacrylate, 2-hydroxyethyl acrylate, dimethylaminoethyl methacrylate and diethylaminoethyl methacrylate.

As the styrene-acrylic copolymer resin, various commercially available products can be suitably used. The commercially available product includes, for example, Himer UNI-3000, TB-1800, TBH-1500 (manufactured by Sanyo Chemical Industry Co.); and CPR-100, 600B, 200, 300, XPA4799, 4800 (manufactured by Mitsui Chemical Co.).

It is preferred that the hydrophobic resin used in the invention has a softening point within a range from 60 to 150° C., and preferably from 70 to 120° C.

Also the water-absorbing resin is not specifically limited in a polymer material constituting it, but is preferably a chemically crosslinked type water-absorbing resin. The absorption amount of deionized water per unit weight of the resin is preferably within a range from 100 to 1000 g/g, and particularly preferably from 300 to 1000 g/g.

The water-absorbing resin includes, for example, a substance prepared by partially crosslinking polyacrylic acid with a sodium salt (e.g. Aquarik (registered trademark) CA manufactured by Nippon Catalyst Co. and Sunfresh ST-500MPS, etc. manufactured by Sanyo Chemical Industry Co.) and starch-acrylic acid graft polymer partial sodium salt (e.g. Sunfresh ST-500MPS. ST-100, manufactured by Sanyo Chemical Industry Co.).

Other examples include crosslinked isobutylene-sodium maleate copolymer, crosslinked styrene-sodium maleate copolymer, grafted starch-sodium polyacrylate, saponified substance of grafted starch-polyacrylonitrile, grafted cellulose-sodium polyacrylate, and vinyl alcohol-sodium (meth)acrylate copolymer, etc. Such a chemically crosslinked type water-absorbing resin can be commercially available.

The water-soluble resin includes, for example, polyvinyl alcohol, polyethylene oxide, polyethylene oxide polypropylene oxide, hydroxymethylcellulose, hydroxyethylcellulose, carboxymethylcellulose, and polyvinyl pyrrolidone.

It is preferred that the hydrophilic resin used in the invention has a softening point within a range from 60 to 150° C. and preferably from 70 to 120° C. When using the sheet coated with a powdery coating composition of the invention, in the image-receiving sheet for an ink-jet recording, the resin in the powdery coating composition is not specifically limited as described above. For example, there can be preferably used hydrophobic resins such as saturated polyester resin, styrene-acrylic copolymer resin, etc.; and mixtures of the hydrophobic resin and water-soluble resin such as polyvinyl alcohol, polyethylene oxide, etc.

The powdery coating composition may contain additives such as colorants or fillers, if necessary. The colorant is preferably a white colorant and, for example, titanium oxide is preferably used but is not limited thereto. The colorant gives a requisite earth color to the substrate. The white colorant gives a white earth color to the substrate. The colorant is usually contained in the powdery coating composition in the amount within a range from 0.5 to 60% by weight, and preferably from 5 to 50% by weight. As the filler, for example, silica and calcium carbonate are used.

The powdery coating composition may further contain an anti-offset agent, if necessary, so as not to cause offset when the powdery coating composition is melted and fixed by heating after it is dry-coated on a substrate. As the anti-offset agent, for example, various waxes having a melting point within a range from 50 to 150° C. are preferably used. Specific examples thereof include paraffin wax and polyolefin wax such as polyethylene wax or polypropylene wax, fatty acid metal salt, fatty acid ester, higher fatty acid, and higher alcohol. Such an anti-offset agent is normally used in the powdery coating composition in the amount within a range from 0.1 to 20% by weight, and preferably from 0.5 to 10% by weight.

As described above, the powdery coating composition containing the colorant, filler and other additives, together with the resin, is obtained by mixing them, melt-kneading at a temperature within a range usually from about 100 to 200° C., preferably from about 130 to 180° C., for several minutes, usually about 3 to 5 minutes, followed by cooling, grinding and further classification of the mixture. The powdery coating composition has an average particle diameter within a range from 0.1 to 30 $\mu$m, preferably from 1 to 25 $\mu$m, and most preferably from 5 to 20 $\mu$m.

As described above, the powdery coating composition contains the colorant, filler and other additives, together with the resin. According to the invention, the resin may be a composite prepared by integrating various resins into a powdery coating composition in various structures or forms in the powdery coating composition.

That is, a most simple powdery coating composition is a composition whose resin component is made of a single resin (e.g. hydrophobic resin) having the same property. According to the invention, however, the resin component in the powdery coating composition may also be a composite made of two or more kinds of resins having different properties.

For example, when a hydrophobic resin is melt-mixed with particles of a water-absorbing resin having an average particle diameter within a range from 1 to 20 μm, preferably from 5 to 15 μm, and, if necessary, together with the above-described additives, and the resulting mixture is ground into particles having an average particle diameter of 5 to 20 μm, the mixture is fractured exclusively at the interface between the hydrophobic resin and water-absorbing resin particles because the particles of water-absorbing resin have a large average particle diameter. As a result, there can be obtained, as a powdery coating composition, particles of hydrophobic resin composition containing the particles of water-absorbing resin while exposing a portion of the particles of the above water-absorbing resin on the surface of the particles of the above hydrophobic resin.

Then, when the particles of the hydrophobic resin composition are mixed with inorganic fine particles as described above, a powdery mixture can be obtained. The proportion of the water-absorbing resin particles is preferably from 5 to 50% by weight, and particularly preferable from 10 to 30% by weight, based on the total amount of the hydrophobic resin and the particles of water-absorbing resin.

Since the above-mentioned chemically crosslinked type water-absorbing resin is not melted by heating, even when the hydrophobic resin is melted and mixed with the water-absorbing resin having an average particle diameter of larger than 20 μm and the mixture is ground, it is difficult to uniformly disperse the water-absorbing resin in the hydrophobic resin. Therefore, the particles of the water-absorbing resin and the hydrophobic resin each exist as independent particles. In the invention, however, when the particles of the water-absorbing resin and the hydrophobic resin are melt-kneaded and ground, it is not necessary to disperse all of the particles of water-absorbing resin used in the hydrophobic resin and a portion of the particles of the water-absorbing resin may exist as independent particles from the resulting particles of hydrophobic resin composition. When the average particle diameter of the particles of the water-absorbing resin is smaller than 1 μm, the particles of the water-absorbing resin are uniformly dispersed in the mixture and, therefore, the mixture is hardly fractured at the interface.

According to such a powdery coating composition, since a portion of the particles of the water-absorbing resin is exposed on the surface of the particles of the hydrophobic resin, thus affording the hydrophilicity to the particles of the hydrophobic resin, the absorbency and color developing property of ink can be imparted to the resulting ink-receiving layer.

According to the invention, when a hydrophobic resin and a water-soluble resin are optionally melt-kneaded with the additives and the resulting mixture is ground into particles having an average particle diameter within a range from 1 to 30 μm, preferably from 5 to 20 μm, the hydrophilic resin is dispersed in the mixture in the form of particles because the hydrophilic resin has poor compatibility with the hydrophobic resin. As a result, the mixture is fractured exclusively at the interface between the hydrophobic resin and the particles of the water-soluble resin, thereby making it possible to obtain, as a powdery coating composition, particles of the hydrophobic resin composition containing the above particles of the water-absorbing resin while exposing a portion of the particles of the water-absorbing resin on the surface of the particles of the hydrophobic resin.

Then, when the powdery coating composition is mixed with inorganic fine particles as described above, the powdery mixture as described hereinbefore can be obtained. The proportion of the particles of the water-absorbing resin is preferably from 5 to 50% by weight, and particularly preferable from 10 to 30% by weight, based on the total amount of the hydrophobic resin and water-absorbing resin.

Such a particle of the powdery coating composition as described above is schematically shown in FIG. 1. That is, the powdery coating composition is composed of particles 11 of water-soluble resin and a hydrophobic resin 12, and the particles of the water-soluble resin are dispersed in the particles of the hydrophobic resin while exposing a portion of the particles of the water-soluble resin on the surface of the particles of the hydrophobic resin. The powdery coating composition obtained by melt-kneading a hydrophobic resin with particles of a water-absorbing resin, followed by grinding and further classification of the mixture also has the same structure.

As described above, according to the powdery coating composition, a portion of the particles of the water-soluble resin is exposed on the surface of the particles of the hydrophobic resin, thus affording hydrophilicity to the particles of the hydrophobic resin. Thus, the absorbency and color developing property of ink can be imparted to the ink-receiving layer formed with the powdery coating composition.

Further according to the invention, when a hydrophobic resin and a hydrophilic inorganic fine particles having an average particle diameter of 1 to 5 μm are melt-kneaded and the resulting mixture is ground into particles having an average particle diameter of 5 to 20 μm, there can be obtained particles of the hydrophilic resin composition containing the hydrophilic inorganic fine particles while exposing a portion of the hydrophilic inorganic fine particles on the surface of the hydrophobic resin.

As described above, when the hydrophobic resin is melt-kneaded together with the hydrophilic inorganic fine particles and cooled and the resulting mixture was ground into particles having an average particle diameter of 5 to 20 μm, the mixture was fractured exclusively at the interface between the hydrophobic resin and inorganic fine particles because the hydrophilic inorganic fine particles have a comparatively large average particle diameter, as the result, thereby making it possible to obtain particles of hydrophobic resin composition wherein a portion of the inorganic fine particles having a large particle diameter is exposed on the surface of the particles of the hydrophobic resin.

According to such a powdery coating composition, a portion of the inorganic fine particles is exposed on the surface of the particles of the hydrophobic resin, thus affording hydrophilicity to the particles of the hydrophobic resin. Therefore, the ink-receiving layer formed with such particles of hydrophobic resin composition has absorbency and color developing property of ink.

When the average particle diameter of the (first) hydrophobic inorganic fine particles, which are kneaded with the hydrophobic resin and dispersed in the mixture with the hydrophobic resin, is smaller than 1 μm, the (first) inorganic fine particles are uniformly dispersed in the mixture and the mixture is hardly fractured at the interface. On the other hand, when the average particle diameter of the first hydrophilic inorganic fine particles is larger than 5 μm, the first inorganic fine particles exist together with the hydrophobic resin composition particles, as independent particles. Therefore, as described below, in the case where a powdery mixture prepared by mixing this powdery coating composition with the hydrophilic second inorganic fine particles having an average particle diameter of 1 nm to 1 μm thereby to coat the surface of the particles of the hydrophobic resin composition with the hydrophilic second inorganic fine particles is dry-coated on the substrate and the powdery mixture is fixed by heating, good fixing is likely to be impaired.

The proportion of (first) inorganic fine particles is preferably within a range from 5 to 50% by weight, and particularly preferable from 10 to 30% by weight, based on the total amount of the hydrophobic resin and the (first) inorganic fine particles.

As hydrophilic (first) inorganic fine particles having an average particle diameter of 1 to 5 μm to be dispersed in the hydrophobic resin, for example, a commercially available product can be suitably used. Such a commercially available product includes, for example, silica such as Carplex (manufactured by Shionogi Pharmaceutical Co.), Mizukasil (manufactured by Mizusawa Chemical Industry Co.), Fineseal X-37, 40, 70, 80, etc. (manufactured by Tokuyama Co.); and calcium carbonate such as ED-I, ED-III, ED-V (manufactured by Yonesho Sekkai Kogyo Co.), Calright KT, etc. (manufactured by Shiraishi Calcium Co.).

Also regarding the powdery coating composition wherein the hydrophilic inorganic fine particles are dispersed in the particles of hydrophobic resin while exposing the surface of a portion of the inorganic fine particles, the structure becomes apparent by displacing the particles of water-soluble resin with the hydrophilic inorganic fine particles in FIG. 1.

Furthermore, according to the invention, the powdery coating composition may be prepared by optionally mixing the hydrophobic resin with two or more kinds selected from the water-absorbing resin, water-soluble resin and hydrophilic inorganic fine particles, followed by melt-kneading, grinding and further classification of the mixture. Particularly, a powdery coating composition obtained by mixing the hydrophobic resin with the water-soluble resin and hydrophilic inorganic fine particles, followed by melt-kneading, grinding and further classification of the mixture is a preferred example of the powdery coating composition used in the present invention.

In the preparation of such a powdery coating composition, the water-soluble resin and hydrophilic inorganic fine-particles are, respectively, used in the amount within a range from 5 to 50% by weight, and their total amount is preferably from 10 to 60% by weight.

According to the invention, when such a powdery coating composition is mixed with inorganic fine particles having an average particle diameter within a range from 1 nm to 1 μm to form a powdery mixture, as described above, and the resulting powdery mixture is dry-coated on the surface of a substrate, melted by heating and then fixed, a porous and continuous resin layer comprising particles of the powdery coating composition and a substantially continuous film composed of the inorganic fine particles and provided between the particles of powdery coating composition to form space at least in part therebetween can be formed on the substrate.

The thickness of the resin layer formed of the powdery coating composition is usually within a range from 1 to 100 μm, preferably from 2 to 80 μm, and particularly preferable from 5 to 50 μm.

According to the invention, the resin layer of the powdery coating composition may be formed by dry-coating the powdery mixture directly on a substrate, melting the powdery mixture by heating and fixing it, but an under-coat made of a proper resin may also be optionally provided so as to enhance the adhesion between the resin layer and the substrate, or the smoothness of the substrate. Such an undercoat may be provided by dry-coating a proper powdery coating or coating of the resin solution.

Figure 2:
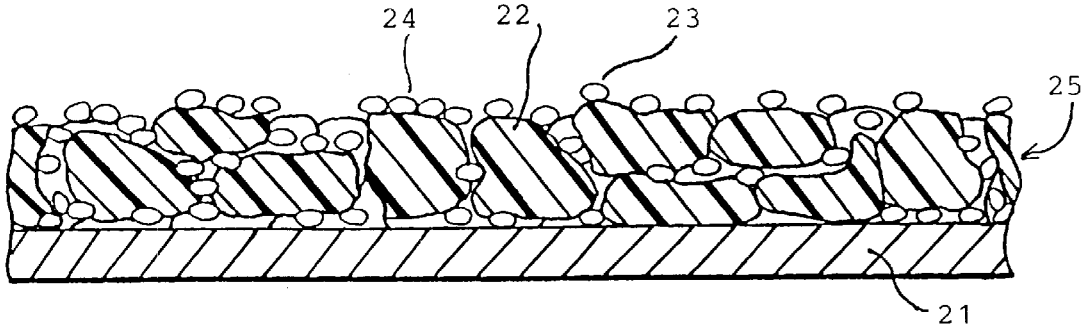
FIG. 2 is a schematic view showing a section of one preferred embodiment of a sheet coated with the powdery coating composition according to the invention.

FIG. 2 shows schematically a section of one embodiment of a sheet coated with such a powdery coating composition according to the invention. On a substrate 21 there is provided a porous and continuous resin layer 25 comprising particles of a powdery coating composition 22 and a substantially continuous film 24 composed of inorganic fine particles 23 and forming space between the particles of the powdery coating composition, while a portion of the inorganic fine particles 23 is exposed on the surface of the resin layer 25.

The resin layer having such a specific structure can be obtained by mixing the inorganic fine particles with the powdery coating composition in a predetermined proportion to form a powdery mixture, dry-coating the powdery mixture on a substrate, melting the powdery mixture by heating and fixing it. The proportion of the inorganic fine powders is usually within a range from 0.5 to 10% by weight, preferably from 1 to 9% by weight, and most preferably from 5 to 8% by weight, in the powdery mixture composed of the powdery coating composition and inorganic fine powders. However, the proportion can be experimentally decided according to each average particle diameter of the powdery coating composition and inorganic fine particles used, most preferably.

In a case where the proportion of the inorganic fine particles is too small, when the above powdery mixture is melted by heating thereby to fix on the substrate, it is impossible to form a porous and continuous resin layer comprised of particles of the powdery coating composition having a substantially continuous film of inorganic fine particles provided between the particles of the powdery coating composition to form space therebetween. Accordingly, the image obtained by ink-jet recording has not sufficient density. On the other hand, when the proportion of the inorganic fine particles is too large, fixing of the resin layer formed on the substrate is poor and the resin layer is liable to be peeled off from the substrate when the substrate is folded. Furthermore, the proportion of the powdery coating composition comprised of the resin is too small and there is a fear that the density of the image formed on the resin layer as the ink-receiving layer becomes insufficient.

When the average particle diameter of the inorganic fine particles is smaller than 1 nm, even if the inorganic fine particles are used in a comparatively large amount, a porous and continuous resin layer having space between the particles of the powdery coating composition cannot be produced.

On the other hand, when the average particle diameter is larger than 1 μm, it is difficult to fix a powdery mixture of the inorganic fine particles and powdery coating composition on a substrate after dry-coating it on the substrate and melting by heating. Accordingly, the resin layer formed is peeled off from the substrate thereby to cause defects in the resulting coated sheet. Therefore, a high quality image recording cannot be obtained even if such a sheet coated with a powdery coating is used in an image-receiving sheet for an ink-jet recording.

According to the invention, hydrophilic inorganic fine particles are preferred as the above-mentioned inorganic fine particles. Among them, fine particles of hydrophilic inorganic oxide and inorganic carbonate are particularly preferred. If necessary, hydrophilic inorganic fine particles may be used in combination with hydrophobic inorganic fine particles according to the purpose and required characteristics of the resulting sheet coated with a powdery coating.

When using the sheet coated with a powdery coating composition of the invention, as an image-receiving sheet for an ink-jet recording, hydrophilic inorganic fine-particles can be optionally used in combination with hydrophobic inorganic fine-particles so as to control the absorbency of water based jet printing ink of the ink-receiving layer.

These inorganic fine particles are commercially available easily. The commercially available product of the hydrophilic inorganic fine particles includes inorganic oxide fine particles, for example, Aerosil® 50, 90G, 130, 200, 200V, 200CF, 200FAD, 300, 300CF, 380, OX50, TT600, MOX80, MOX170, COK 84 (anhydrous silica, manufactured by Nippon Aerosil Co.); Aluminum Oxide C, Titanium Dioxide P25 (manufactured by Nippon Aerosil Co.); Caplex® FPS-2, FPS-3, FPS-4, FPS-5, FPS-101, CS-5, CS-7, BS-304F, BS-304N (manufactured by Shionogi & Co.); and inorganic oxide fine particles S13, V15, N20, T30, T40 (anhydrous silica, manufactured by Clariant Japan Co.). Calite KT as calcium carbonate manufactured by Shiraishi Industry Co. can also be used as the hydrophilic inorganic fine-particles.

On the other hand, the commercially available product of the hydrophobic inorganic fine particles includes, for example, Aerosil® R972, R972V, R972CF, R974, R202, R805, R812S (anhydrous silica, manufactured by Nippon Aerosil Co.); T805, RX200, RY200 (titanium dioxide, manufactured by Nippon Aerosil Co.); and H15, H20, H30, H2000, H2000/4, H3004, H2015EP, H2050EP (anhydrous silica, manufactured by Clariant Japan Co.).

Such a sheet coated with a powdery coating composition according to the invention has a porous and continuous resin layer comprising particles of powdery coating composition and a substantially continuous film comprising inorganic fine particles interposed between the particles of the powdery coating composition thereby to form space at least in part therebetween, as described hereinbefore.

As a result, as described above, the inorganic fine particles are exposed on the surface of the resin layer in the form of a film, while the particles of the powdery coating composition are made to contact with each other while interposing the inorganic fine particles therebetween to form space (composed of the inorganic fine particles) at least in part usually of about 1 to 200 nm therebetween. However, in a portion, the particles of powdery coating composition may not be made to contact with each other and pores or voids may be present between the particles.

As described above, since the sheet coated with a powdery coating composition of the invention has a porous and continuous resin layer comprised of particles of the powdery coating composition and inorganic fine particles dispersed and interposed between the particles of powdery coating composition to form at least in part space therebetween, the sheet can be suitably used as an image-receiving sheet for an ink-jet recording.

That is, when water based jet printing ink is adhered to such an image-receiving sheet, water in ink is rapidly permeated through the image-receiving layer along the film composed of the inorganic fine particles interposed between the particles of the powdery coating composition and, at the same time, the resin layer containing the hydrophilic inorganic fine particles and the layer of the hydrophilic inorganic fine particles on the resin layer adsorb and scavenge the colorant made of a dye or pigment in ink. Therefore, high-quality ink-jet recording having excellent absorbency and color developing property can be obtained.

The resin layer comprising the particles of the powdery coating composition is formed on a substrate by dry-coating a powdery mixture composed of the powdery-coating composition and inorganic fine particles on the substrate, heating to melt the powdery coating composition, and fixing the powdery coating composition together with the inorganic fine particles on the substrate.

The powdery mixture can be dry-coated on a substrate, for example, by electrophotographic systems such as electrostatic spray method, electrostatic coating such as electrostatic dipping method, flame spray method, spray coating method, dispersion method, powder coating such as powder melt lamination method, powder scatter method, cascade method, magnetic brush developing method, powder cloud method, open chamber method, fur developing method, print developing method, and a developing method due to electrostatic induction.

Among these dry coating methods, an electrostatic spray method can be preferably used in the invention. This electrostatic spray method is a kind of powder coating, but is specified by transporting a powdery mixture of fine-particles to a tip of a spray gun by air, applying a negative high potential (e.g. −50 to −90 kV) to a needle electrode incorporated into the tip of the spray gun thereby to negatively charge the powder mixture, closely placing an electrode grounded on the back surface of the substrate, and transporting the negatively charged powdery mixture to the substrate due to an electric field, which is present between the spray gun and ground electrode, thereby to adhere the powdery mixture on the substrate electrostatically.

Figure 3:
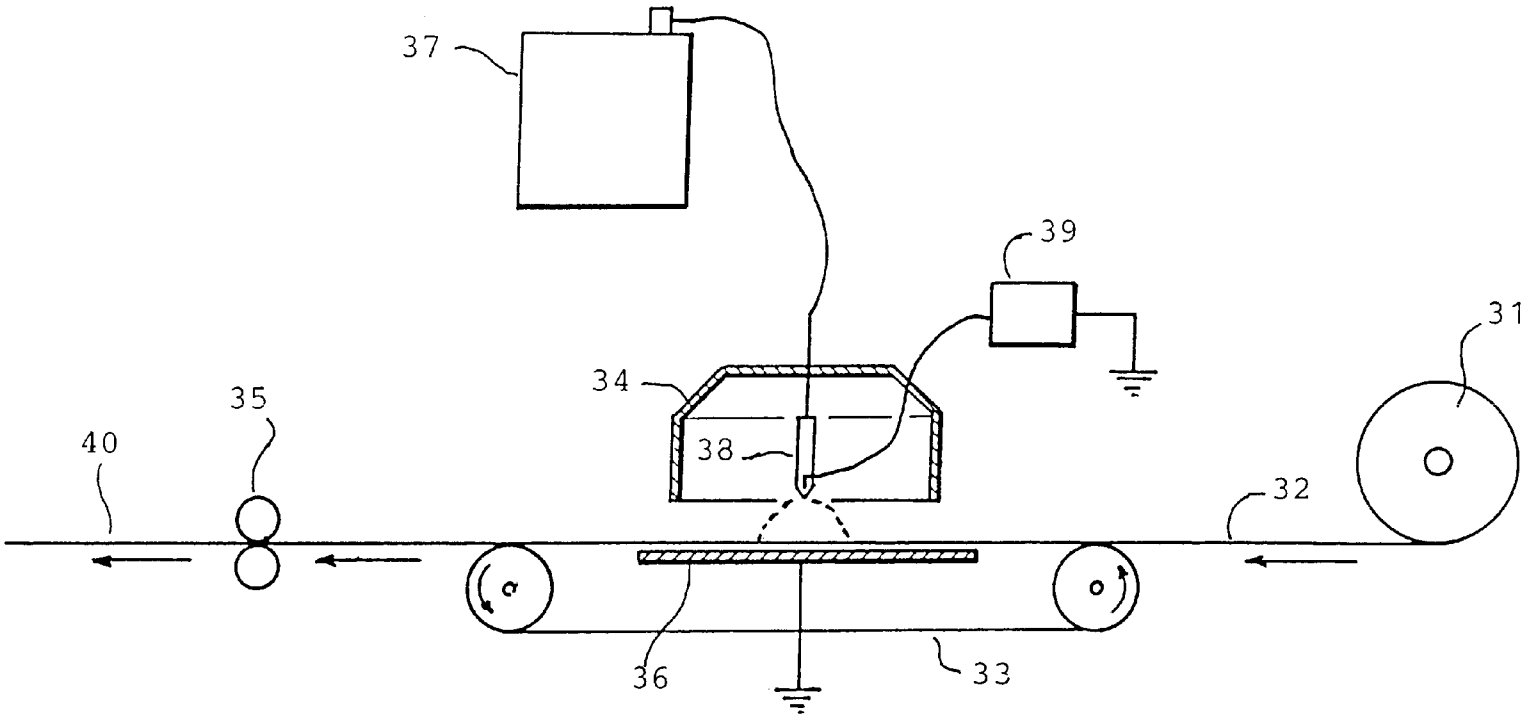
FIG. 3 is a schematic view showing the constitution of a device for producing the sheet coated with the powdery coating composition according to the invention.

FIG. 3 shows preferred embodiment of the method using such an electrostatic spray method according to the invention. That is, a continuous long substrate (e.g. ordinary paper) 32 unwound from a roller 31 is transported into a booth 34 by a carrier belt 33. In the booth, the powdery mixture is dry-coated by the electrostatic spray method, melted by heating by a fixing roller 35, fixed and then wound or appropriately cut, as described below. The carrier belt 33 has an electrode 36 ground on the backside (i.e. positive electrode) along the substrate to be carried by the carrier belt. The powdery mixture is carried to a spray gun 38 from a storage tank 37 by compressed air, while a negative high voltage is applied to a needle electrode (not shown) incorporated into the tip of the spray gun by a d.c. power source and the powdery mixture is negatively charged. Thus, the powdery mixture is transported to the substrate by electric field, which is present between the spray gun and the above electrode along the substrate on the carrier belt, and then adhered to the substrate electrostatically. In such a way, the substrate dry-coated with the powdery mixture is transported to the fixing roller 35, where the powdery mixture is melted by heating and then fixed on the substrate to form a resin layer, thus obtaining a sheet 40 coated with a powdery coating according to the invention.

According to the invention, there is provided a further image-receiving sheet for an ink-jet recording, wherein an ink-receiving layer has a two-layer structure. This image-receiving sheet for an ink-jet recording comprises a resin layer having a thickness of 1 to 100 $\mu$m on a substrate and a surface layer formed on the resin layer. The resin layer is composed of particles of powdery coating composition having an average particle diameter of 0.1 to 30 μm and containing a resin and a colorant. The surface layer is composed of inorganic fine particles having an average particle diameter of 1 to 50 nm. The resin layer preferably has at least in part space between the particles of powdery coating composition.

Such an image-receiving sheet for an ink-jet recording can be obtained according to the invention by a method comprising the step of dry-coating particles of a powdery coating composition having an average particle diameter of 0.1 to 30 μm and containing a resin and a colorant, on a substrate, to form a resin layer, the step of forming a surface layer composed of inorganic fine particles having an average particle diameter of 1 to 50 nm on the resin layer, the step of fixing the resin layer on the substrate, and fixing the surface layer composed of the inorganic fine particles on the resin layer.

More specifically, particles of the powdery coating composition having an average particle diameter of 0.1 to 30 μm and containing a resin and a colorant are dry-coated on a substrate to form a resin layer and then inorganic fine particles having an average particle diameter of 1 to 50 nm are dry-coated on the resin layer to form a surface layer on the resin layer. Then, the laminated sheet thus obtained is heated under pressurizing thereby to fix the resin layer on the substrate and to fix the surface layer of the inorganic fine particles on the resin layer. When the resin layer is formed, the powdery coating composition is heated to a temperature lower than that at which the powdery coating composition is completely melted to form continuous coated film, thereby to incompletely, i.e. partially melt the powdery coating composition. Thus, the powdery coating composition is partially adhered to each other to form a resin layer having space at least in part therebetween.

According to the invention, however, it is preferred that the powdery coating composition is mixed with a predetermined proportion, usually 0.5 to 10% by weight, of a first inorganic fine particles to form a powdery mixture, dry-coating the powdery mixture on a substrate to form, as an ink-receiving layer, a porous and continuous resin layer composed of the particles of the powdery coating composition and inorganic fine particles dispersed between the particles of the powdery coating composition thereby to form space at least in part therebetween, as described above. Then, second inorganic fine particles having an average particle diameter of 1 to 50 nm are preferably dry-coated on the resin layer to form a surface layer, thus obtaining an image-receiving sheet for an ink-jet recording.

The image-receiving sheet for an ink-jet recording as a particularly preferred one embodiment of the invention comprises a substrate and a porous and continuous resin layer having a thickness of 1 to 100 μm provided on the substrate, the resin layer comprising particles of powdery coating composition having an average particle diameter of 0.1 to 30 μm and containing a resin and a colorant, and the first inorganic fine particles having an average particle diameter of 1 nm to 1 μm dispersed between the particles of powdery coating composition to form space at least in part therebetween, the sheet further comprising a surface layer composed of the second inorganic fine particles having an average particle diameter of 1 to 50 nm on the resin layer.

When the average particle diameter of the second inorganic fine particles is larger than 50 nm, in a case where an ink-jet recording of an image-receiving sheet having such a layer of inorganic fine particles is performed, the resulting image sometimes lacks accuracy and an image-receiving sheet for an ink-jet recording capable of affording a high quality recorded image cannot be obtained sometimes. The second inorganic fine particles may have an average particle diameter of smaller than 1 nm, but preferably have an average particle diameter of not less than 1 nm in view of availability.

Such an image-receiving sheet for an ink-jet recording can be obtained by a method comprising the step of dry-coating a powdery mixture prepared by mixing a powdery coating composition having an average particle diameter of 0.1 to 30 μm and containing a resin and a colorant, with the first inorganic fine particles having an average particle diameter of 1 nm to 1 μm on a substrate to form a powdery mixture layer; the step of dry-coating the second inorganic fine particles on the powdery mixture layer to form a surface layer; the step of melting the powdery mixture layer by heating and fixing to form a resin layer; and the step of fixing the surface layer made of the second inorganic fine particles on the resin layer.

Now a preferred embodiment of the production of the image-receiving sheet for an ink-jet recording according to the invention will be described.

For the production of the image-receiving sheet for an ink-jet recording of the invention, first, a powdery coating composition having an average particle diameter of 0.1 to 30 μm, preferably 1 to 25 μm, is mixed with the first inorganic fine particles having an average particle diameter of 1 nm to 1 μm to form a powdery mixture and, the powdery mixture is then dry-coated on a substrate to form a powdery mixture layer. In the invention, an intermediate product wherein the powdery mixture layer is formed on the substrate is referred to as a precursor sheet. Then, the second inorganic fine-particles having an average particle diameter of 1 to 50 nm, preferably from 5 to 30 nm, are dry-coated on the powdery mixture layer of the precursor sheet to form a surface layer. In the invention, an intermediate product wherein the surface layer made of inorganic fine particles is formed on the precursor sheet is referred to as a laminated sheet.

Then, the laminated sheet thus obtained is heated under pressurizing thereby to fix a porous and continuous resin layer comprised of the particles of the powdery coating composition having the first inorganic fine particles dispersed between the particles of the powdery coating to form at least in part space therebetween on the substrate, and pressing a surface layer composed of the second inorganic fine particles on the resin layer thereby to fix it thereon.

However, fixing of the powdery mixture layer and fixing of the surface layer made of the second inorganic fine particles can be conducted separately. That is, the powdery mixture may be dry-coated on the substrate to form a powdery mixture layer, thus obtaining a precursor sheet, which may be heated under pressure thereby to melt the powdery coating composition and to fix on the substrate to form a resin layer on the substrate. Then, the second inorganic fine particles are dry-coated on the resin layer and heated again under pressure thereby to fix the inorganic fine particles on the resin layer to form a surface layer.

The surface layer comprised of the second inorganic fine particles may contain a binder and other additives. Particularly, the surface layer can be fixed to the resin layer as the ink-receiving layer, more strongly, when the surface layer contains a binder. The binder is not specifically limited, but various resins such as a resin for forming the powdery coating composition can be used.

Among the various resins mentioned hereinbefore, when the hydrophobic resin, water-soluble resin or a mixture of these is used as a powder to mix with the second inorganic fine particles and the resulting mixture is dry-coated on a resin layer as the ink-receiving layer and then heated under pressure, the second inorganic fine particles are pressed on the resin layer while binding each other by the binder, thereby bonding the second inorganic fine particles strongly on the resin layer. The binder is usually used in an amount within a range from 1 to 200 parts by weight, and preferably from 5 to 100 parts by weight, based on 100 parts by weight of the second inorganic fine particles.

However, the surface layer composed of the second inorganic fine particles may be formed optionally by wet-coating, and not dry-coating described above. That is, a surface layer composed of the second inorganic fine particles can also be formed on the resin layer by dispersing the second inorganic fine particles in a medium, preferably aqueous medium such as water, adding a binder to prepare a coating solution, coating the coating solution on a resin layer as the image-receiving layer, and drying the coating solution. When the powdery coating composition forming the resin layer is not dissolved or swollen, a binder may be formed by using a non-aqueous (or an organic) solvent.

In a case where a surface layer made of the second inorganic fine particles is formed on a resin layer as the ink-receiving layer by wet-coating, various resins can be used as a latex, including water-soluble resin. As for the latex, for example, there can be preferably used latex of hydrophobic resin, such as (meth)acrylic resin, styrene-acrylic copolymer resin, ethylene-vinyl acetate copolymer resin, polyvinyl acetal resin, epoxy resin, styrene-butadiene copolymer resin, polyethylene resin and polypropylene resin.

The image-receiving sheet for an ink-jet recording thus obtained has the resin layer usually of a thickness within a range from 1 to 100 $\mu$m, preferably from 2 to 80 $\mu$m, and particularly preferable from 5 to 50 $\mu$m. The surface layer composed of the second inorganic fine particles usually has a thickness of 10 nm to 3 $\mu$m, and preferably from 20 nm to 1 $\mu$m.

Figure 4:
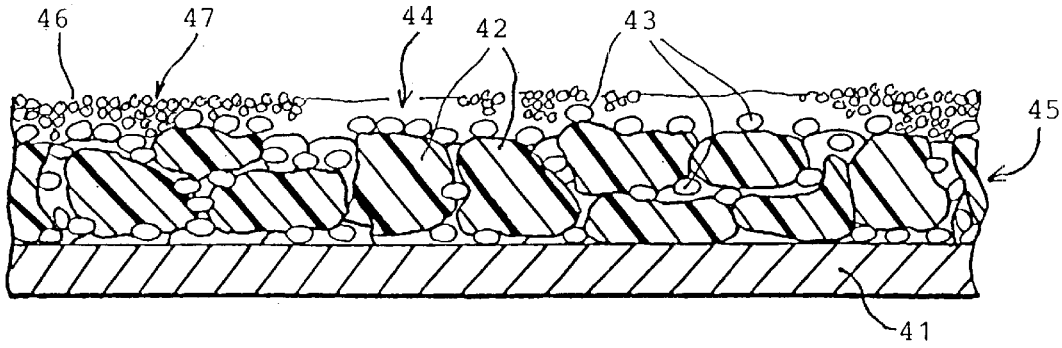
FIG. 4 is a schematic view showing a section of one preferred embodiment of an image-receiving sheet for an ink-jet recording according to the invention.

FIG. 4 schematically shows a section of one preferred embodiment of the image-receiving sheet for an ink-jet recording according to the invention. On a substrate 41, each of the particles of the powdery coating composition 42 forms a porous and continuous resin layer 45 while a substantially continuous film 44 composed of the first inorganic fine particles 43 is interposed between the particles of the powdery coating composition to form space therebetween, and a portion of the first inorganic fine particles 43 is exposed on the surface of the resin layer 45. A surface layer 47 comprised of the second inorganic fine particles 46 is further formed on the resin layer 45.

The second inorganic fine particles are preferably hydrophilic, and fine particles of hydrophilic inorganic oxide or carbonate are particularly preferred. However, hydrophilic inorganic fine particles may be optionally used in combination with hydrophobic inorganic fine particles.

The second inorganic fine particles include, for example, the same first inorganic fine particles as those described above. However, the first inorganic fine particles and second inorganic fine particles may be the same or different.

As described above, the image-receiving sheet for an ink-jet recording according to the invention comprises a substrate and a porous and continuous resin layer as a first layer on the substrate, the resin layer comprising particles of powdery coating composition and a substantially continuous film comprised of the first inorganic fine particles interposed or dispersed between the particles of powdery coating composition to form space at least in part therebetween, and the sheet further comprising a surface layer comprised of the second inorganic fine particles as a second layer on the resin layer. Therefore, when water based jet printing ink is adhered to the image-receiving sheet, a dye or pigment in ink is rapidly adsorbed and scavenged by the surface layer of the hydrophilic second inorganic fine particles constituting the surface layer of the image-receiving layer, thereby making it possible to form a high density image.

Moreover, the image-receiving sheet of the invention has a porous and continuous resin layer comprising particles of powdery coating composition and a substantially continuous film composed of the first inorganic fine particles dispersed between the particles of the powdery coating composition to form space at least in part therebetween under the surface layer composed of the second inorganic fine particles. Thus, water in jet printing ink penetrates through the surface layer composed of the second inorganic fine particles and is rapidly adsorbed and scavenged along the film composed of inorganic fine particles between the particles of the powdery coating composition, and then retained in the image-receiving layer.

Thus, water does not reach the substrate, that is, the substrate is not wetted even if the substrate is paper. On the other hand, water is adsorbed and scavenged by the first inorganic fine particles even if the substrate is a synthetic resin film and, therefore, the image is not smudged.

The second inorganic fine particles are dry-coated on the resin layer by various methods, like the case where the powdery mixture is dry-coated on the substrate, and an electrostatic spray method can be used, particularly preferable.

Such a two-layer structure image-receiving sheet for ink-jet recording can be continuously produced using an electrostatic spray method, for example, by forming a resin layer comprised of a powdery mixture on a substrate, transporting into a second booth, dry-coating the second inorganic fine particles on the resin layer by using a second spray gun, pressing the second inorganic fine-particles by heating on the resin layer, and fixing, as described with reference to FIG. 3.

EXAMPLES

The following examples further illustrate the invention in detail but are not to be construed to limit the scope thereof. In the following examples, parts and percentages are by weight unless otherwise stated.

Example 1

Preparation of Powdery Coating Composition and Powdery Mixture 40 parts of a saturated polyester resin (FC-344, manufactured by Mitsubishi Rayon Co.), 30 parts of a styrene-acrylic copolymer resin (CPR-200, manufactured by Mitsui Chemical Co.) and 25 parts of a white colorant (titanium oxide (Taipake A220), manufactured by Ishihara Sangyo Co.) were melt-kneaded in a double-screw melt-kneader at 150–160° C. for 4 minutes. After cooling, the resulting mixture was ground and classified to obtain a white powdery coating composition having an average particle diameter of 11.0 $\mu$m. 95 parts of the white powdery coating composition were mixed with 5 parts of a hydrophilic anhydrous silica (Aerosil 200, average particle diameter: 12 nm, manufactured by Nippon Aerosil Co.) to obtain a white powdery mixture (proportion of anhydrous silica: 5%) for dry coating by an electrostatic spray method.

Production of Image-receiving Sheet for an Ink-jet Recording)

Using a commercially available electrostatic spray device, the above white powdery mixture was adhered on the entire surface of a commercially available ordinary paper, followed by melting by heating and further fixing to form an image-receiving layer having a thickness of 20 μm, thus obtaining a sheet coated with a powdery coating composition.

Figure 5:
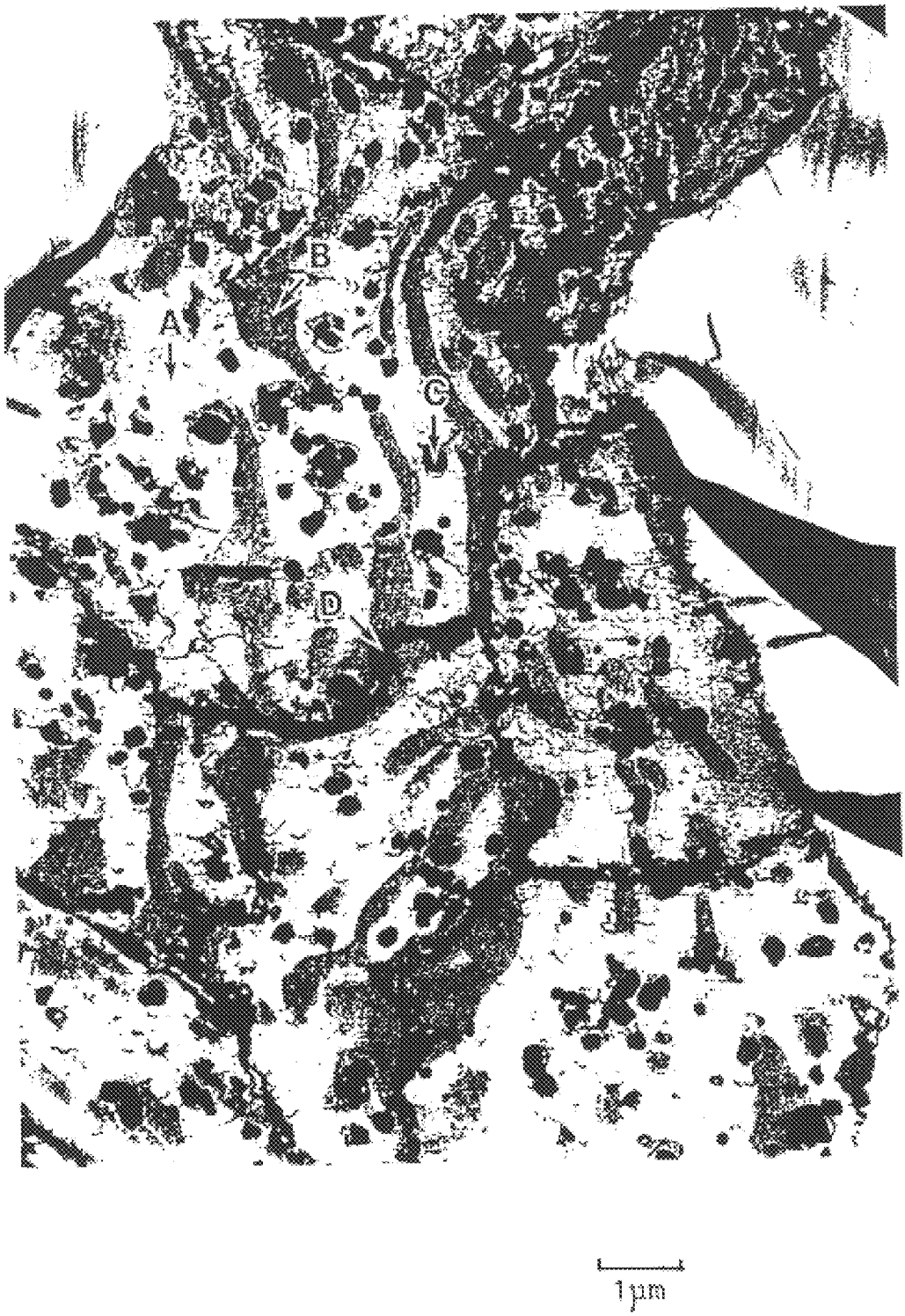
FIG. 5 is a transmission electron micrograph showing the structure of powdery coating composition particles in a resin layer as one embodiment of the sheet coated with the powdery coating composition according to the invention.

Only the resin layer of the thus obtained sheet was embedded into an epoxy resin and then frozen to prepare a thin film having a thickness of about 1000 Å. The thin film was dyed with ruthenium oxide, reinforced with carbon and then observed by a transmission electron microscope. A transmission electron micrograph of a section of the resin layer of the sheet is shown in FIG. 5. In the electron micrograph, the white portion shows an epoxy resin and the left side portion shows a resin layer. The region A is composed of a polyester resin, the region B a styrene-acrylic copolymer resin, the particles C are composed of titanium dioxide, and the region D is composed of fine particles of silica which is substantially continuous in the form of a film and dispersed between the respective particles of powdery coating composition, thereby to form space between the particles of powdery coating composition.

Ink-jet Recording

Using a commercially available ink-jet printer (manufactured by Epson Co.), an ink-jet recording of an image-receiving sheet was performed. As a result, a high quality recorded image could be obtained rapidly.

Production of Image-receiving Sheets Having Different Amounts of Silica and Evaluation of Performances In the same manner as described above, 40 parts of a saturated polyester resin, 30 parts of a styrene-acrylic copolymer resin, 0.3, 1, 3, 8 or 12 parts of anhydrous silica, and a white colorant were used so that the total amount of these became 100 parts to prepare a white powdery mixture for dry coating, which contains 0.3, 1, 3, 8 or 12% of anhydrous silica. Using the resulting white powdery mixture, an image-receiving sheet for an ink-jet recording was produced and ink-jet recording of the image-receiving sheet was performed.

The case where the image-receiving layer was not changed even when each image-receiving sheet for an ink-jet recording thus obtained was bent was rated with an excellent fixing (A) of the image-receiving layer to the substrate, while the case where powders were peeled from the image-receiving sheet when the image-receiving sheet was bent was rated with poor fixing (B).

With respect to each image-receiving sheet, the density of the resulting image due to an ink-jet recording was measured by using a densitometer (PDA-60, manufactured by Konica Co.). As a result, the case where density of yellow and that of magenta are not less than 0.9 and density of cyan is not less than 0.5 was rated excellent image density (A), while the case where the density of yellow and that of magenta are smaller than 0.9 or the density of cyan is smaller than 0.5 was rated poor image density (B).

Furthermore, the permeability of ink to the image-receiving layer and the fixing of ink to the image-receiving layer in an ink-jet recording were examined in the following procedure. With respect to the permeability of ink, the case where jet printing ink permeated through the image-receiving layer to form a clear image was rated excellent permeability (A), while the case where ink did not permeate through the image-receiving layer and the image-receiving layer repelled ink was rated poor permeability (B). The above results are shown in Table 1.

TABLE 1

| | Amount of Silica (% by weight)*) | | | | | |
|---|---|---|---|---|---|---|
| | 0.3 | 1.0 | 3.0 | 5.0 | 8.0 | 12.0 |
| Image Density | A | A | A | A | A | A |
| Permeability | B | A | A | A | A | A |
| Fixing | A | A | A | A | A | B |

*)Proportion of silica to the total of powdery coating composition and silica (powdery mixture)

Example 2

Preparation of Powdery Coating Composition and Powdery Mixture 70 parts of a styrene-acrylic copolymer resin (CPR-200, manufactured by Mitsui Chemical Co.) and 22 parts of a white colorant (titanium oxide (Taipake R550), manufactured by Ishihara Sangyo Co.) were melt-kneaded in a double-screw melt-kneader at 150–160° C. for 4 minutes. After cooling, the resulting mixture was ground and classified to obtain a white powdery coating composition having an average particle diameter of 11.0 μm. 92 parts of the white powdery coating composition was mixed with 8 parts of a hydrophilic anhydrous silica (Aerosil 200CF, average particle diameter: 12 nm, manufactured by Nippon Aerosil Co.) to obtain a white powdery mixture (proportion of anhydrous silica: 8%) for dry coating by an electrostatic spray method.

In the same manner as described in Example 1, 70 parts of a styrene-acrylic copolymer resin, 3 or 5 parts of anhydrous silica and a white colorant were used so that the total weight of these became 100 parts to prepare a white powdery mixture for dry coating, which contains 3 or 5% of anhydrous silica.

Production of Image-receiving Sheet for an Ink-jet Recording

Using a commercially available electrostatic spray device, the above white powdery mixture was adhered on the entire surface of a commercially available ordinary paper, followed by melting by heating and further fixing to form an image-receiving layer having a thickness of 20 μm, thus obtaining an image-receiving sheet for an ink-jet recording.

Ink-jet Recording

Using a commercially available ink-jet printer (manufactured by Epson Co.), an ink-jet recording of each image-receiving sheet thus obtained was performed. As a result, a high quality recorded image could be obtained rapidly in the case of any image-receiving sheet.

In the same manner as in Example 1, the fixing of the image-receiving layer to the substrate, image density due to an ink-jet recording, and permeability of ink to the image-receiving layer in an ink-jet recording were evaluated. As a result, any image-receiving sheet was rated 'A'.

Example 3

Preparation of Powdery Coating Composition and Powdery Mixture 70 parts of a styrene-acrylic copolymer resin (CPR-200, manufactured by Mitsui Chemical Co.) and 22 parts of a white colorant (titanium oxide (Taipake R550), manufactured by Ishihara Sangyo Co.) were melt-kneaded in a double-screw melt-kneader at 150–160° C. for 4 minutes. After cooling, the resulting mixture was ground and classified to obtain a white powdery coating composition having an average particle diameter of 11.0 μm. 92 parts of the white powdery coating composition was mixed with 8 parts of hydrophilic aluminum oxide (Aluminum Oxide C, average particle diameter: 13 nm, manufactured by Nippon Aerosil Co.) to obtain a white powdery mixture (proportion of aluminum oxide: 8%) for dry coating by an electrostatic spray method.

In the same manner as in Example 1, 70 parts of a styrene-acrylic copolymer resin, 3 or 5 parts of aluminum oxide and a white colorant were used so that the total weight of these became 100 parts to prepare a white powdery mixture for dry coating, which contains 3 or 5% by weight of aluminum oxide.

Production of Image-receiving Sheet for an Ink-jet Recording

Using a commercially available electrostatic spray device, the above white powdery mixture was adhered on the entire surface of a commercially available ordinary paper, followed by melting by heating and further fixing to form an image-receiving layer having a thickness of 20 μm, thus obtaining an image-receiving sheet for an ink-jet recording.

Ink-jet Recording

Using a commercially available ink-jet printer (manufactured by Epson Co.), an ink-jet recording of each image-receiving sheet thus obtained was performed. As a result, a high quality recorded image could be obtained rapidly in the case of any image-receiving sheet.

In the same manner as in Example 1, the fixing of the image-receiving layer to the substrate, image density due to ink-jet recording, and permeability of ink to the image-receiving layer in an ink-jet recording were evaluated. As a result, any image-receiving sheet was rated 'A'.

Example 4

Preparation of Powdery Coating Composition and Powdery Mixture

70 Parts of a styrene-acrylic copolymer resin (CPR-200, manufactured by Mitsui Chemical Co.) and 22 parts of a white colorant (titanium oxide (Taipake R550), manufactured by Ishihara Sangyo Co.) were melt-kneaded in a double-screw melt-kneader at 150–160° C. for 4 minutes. After cooling, the resulting mixture was ground and classified to obtain a white powdery coating composition having an average particle diameter of 11.0 μm. 92 parts of this white powdery coating composition was mixed with 8 parts of a hydrophilic anhydrous titanium dioxide (Titanium Dioxide P25, average particle diameter: 21 nm, manufactured by Nippon Aerosil Co.) to obtain a white powdery mixture (proportion of titanium dioxide: 8%) for dry coating by an electrostatic spray method.

In the same manner as in Example 1, 70 parts of a styrene-acrylic copolymer resin, 3 or 5 parts of titanium dioxide (P25) and a white colorant were used so that the total weight of these became 100 parts to prepare a white powdery mixture for dry coating, which contains 3 or 5% by weight of titanium dioxide (P25).

Production of Image-receiving Sheet for an Ink-jet Recording

Using a commercially available electrostatic spray device, the above white powdery mixture was adhered on the entire surface of a commercially available ordinary paper, followed by melting by heating and further fixing to form an image-receiving layer having a thickness of 20 μm.

Ink-jet Recording

Using a commercially available ink-jet printer (manufactured by Epson Co.), an ink-jet recording of each image-receiving sheet thus obtained was performed. As a result, a high quality recorded image could be obtained rapidly in the case of any image-receiving sheet.

In the same manner as in Example 1, the fixing of the image-receiving layer to the substrate, image density due to ink-jet recording, and permeability of ink to the image-receiving layer in an ink-jet recording were evaluated. As a result, any image-receiving sheet was rated 'A'.

Comparative Example 1

The white powdery coating composition prepared in Example 1 was dissolved in methyl ethyl ketone to prepare an oil base coating composition. The composition was coated on a ordinary paper using a bar coater and then dried to obtain an image-receiving sheet for an ink-jet recording.

Using the same commercially available ink-jet printer as in Example 1, an ink-jet recording of the image-receiving sheet was performed. However, the image-receiving layer repelled jet printing ink and an image could not be recorded.

Example 5

Preparation of Powdery Coating Composition and Powdery Mixture 50 parts of a saturated polyester resin (FC-714, manufactured by Mitsubishi Rayon Co.) and 45 parts of a white colorant (titanium oxide (Taipake A220), manufactured by Ishihara Sangyo Co.) were melt-kneaded in a double-screw melt-kneader at 150–160° C. for 4 minutes. After cooling, the resulting mixture was ground and classified to obtain a white powdery coating composition having an average particle diameter of 11.0 μm. 95 parts of this white powdery coating composition was mixed with 5 parts of a hydrophilic anhydrous silica (Aerosil 200, average particle diameter: 12 nm, manufactured by Nippon Aerosil Co.) to obtain a white powdery mixture (proportion of anhydrous silica: 5%) for dry coating by an electrostatic spray method.

Production of Image-receiving Sheet for an Ink-jet Recording

Using a commercially available electrostatic spray device, the above white powdery mixture was adhered on the entire surface of a commercially available ordinary paper to form a resin layer. Using the same device, a hydrophilic anhydrous silica (Aerosil 200, average particle diameter: 12 nm, manufactured by Nippon Aerosil Co.) as the second inorganic fine particles was adhered on the above resin layer. Then, the laminated sheet thus obtained was heated under pressure, thereby to fix the resin layer on the ordinary paper.

At the same time, the second inorganic fine-particles were fixed on the resin layer by pressing, thus obtaining an image-receiving sheet for an ink-jet recording having a surface layer composed of the second inorganic fine particles having a thickness of about 1 μm on an image-receiving layer having a thickness of 20 μm.

Ink-jet Recording

Using a commercially available ink-jet printer (manufactured by Epson Co.), an ink-jet recording of each image-receiving sheet thus obtained was performed. As a result, an accurate recorded image having high density could be obtained rapidly.

Comparative Example 2

In the same manner as in Example 5, except that particles of polymethyl methacrylate having an average particle diameter of 150 nm were used as the second inorganic fine particles, an image-receiving sheet for an ink-jet recording having a surface layer composed of particles of polymethyl methacrylate having a thickness of about 3 μm on an image-receiving layer having a thickness of 20 μm was obtained.

In the same manner as in Example 5, an ink-jet recording of the image-receiving sheet for an ink-jet recording was performed. However, the image-receiving sheet repelled ink and an image could not be recorded.

Comparative Example 3

In the same manner as in Example 5, except that a hydrophilic silica having a particle diameter of 5 to 50 μm was used as the second inorganic fine particles, an image-receiving sheet for an ink-jet recording having a surface layer composed of the above silica having a thickness of about 50 μm on an image-receiving layer having a thickness of 20 μm was obtained.

In the same manner as in Example 5, an ink-jet recording of the image-receiving sheet for an ink-jet recording was performed. As a result, ink was not absorbed into particles of the hydrophilic silica of the surface layer of the image-receiving sheet, but permeated through a space between the silica particles. Therefore, ink dots were not formed on the outermost surface of the image-receiving sheet and only an image having low density was formed. In an ink-jet recording, an image having high density cannot be formed until ink dots are not formed on the outermost surface of the image-receiving sheet.

Example 6

Preparation of Powdery Coating Composition 80 parts of a styrene-acrylic copolymer resin (Himer Uni-3000, softening point: 98 C, manufactured by Sanyo Chemical Industry Co.) and 20 parts of fine particles of hydrophilic silica (Mizukasil P-527, average particle diameter: 1.6 μm, manufactured by Mizusawa Chemical Industry Co.) were melt-kneaded. After cooling, the resulting mixture was ground and classified to obtain a hydrophobic resin powdery coating composition having an average particle diameter of 11.0 μm. 100 parts of this hydrophobic resin powdery coating composition and 5 parts of fine-particles of hydrophilic silica (average particle diameter: 12 nm, manufactured by Nippon Aerosil Co.) were mixed by stirring to obtain a powdery mixture.

Production of Image-receiving Sheet for an Ink-jet Recording

Using a commercially available electrostatic spray device, the above powdery mixture was sprayed on the entire surface of a commercially available ordinary paper and the powdery mixture was heated to about 80 to 100° C. under pressure, thereby to fix the powdery mixture to the ordinary paper. At the same time, particles of powdery coating composition were fused to each other, partially, to form a resin layer having a thickness of 20 μm, having space between the particles, as an image-receiving layer Thus, an image-receiving sheet for an ink-jet recording was obtained.

Ink-jet Recording Characteristics

Using a commercially available ink-jet printer (PM-750C, manufactured by Epson Co.), an ink-jet recording of the image-receiving sheet for an ink-jet recording was performed, and then the absorbency and color developing property of ink was examined. The absorbency of ink was examined as follows. A color chart defined by the Japanese Standards Society was ink-jet recorded on a recording paper and, immediately after recording, the image was touched by fingertip. The case where ink was not adhered to the fingertip was rated "good", while the case where ink was partially adhered to the fingertip was rated "poor". The color developing property of ink was examined by measuring the density of the most dense portion using a Macbeth densitometer (model RD-914). The results are shown in Table 2.

Example 7

In the same manner as in Example 6, except that 80 parts of a styrene-acrylic copolymer resin and 20 parts of fine particles of hydrophilic calcium carbonate (ED-V, average particle diameter: 5.0 μm, manufactured by Yonesho Sekkai Kogyo Co.) were melt-kneaded to prepare a powdery mixture and an image-receiving sheet for an ink-jet recording was prepared by using the powdery mixture. In the same manner as in Example 6, the absorbency and color developing property of ink was examined. The results are shown in Table 2.

Comparative Example 4

In the same manner as in Example 6, except that 90 parts of a styrene-acrylic copolymer resin and 10 parts of fine particles of hydrophilic silica (Aerosil 50, average primary particle diameter: 30 nm, manufactured by Nippon Aerosil Co.) were melt-kneaded to prepare a powdery mixture and an image-receiving sheet for an ink-jet recording was prepared by using the powdery mixture. In the same manner as in Example 6, the absorbency and color developing property of ink was examined. The results are shown in Table 2.

Example 8

93 parts of a styrene-acrylic copolymer resin (Himer Uni-3000, softening point: 98° C., manufactured by Sanyo Chemical Industry Co.) and 7 parts of a water-absorbing resin (prepared by partially crosslinking polyacrylic acid with a sodium salt, average particle diameter: 6.0 μm) were melt-kneaded. After cooling, the resulting mixture was ground and classified to obtain a hydrophobic resin powdery coating composition having an average particle diameter of 11.0 μm. Then, 100 parts of the hydrophobic resin powdery coating composition and 5 parts of fine-particles of hydrophilic silica (Aerosil 200, average particle diameter: 12 nm, manufactured by Nippon Aerosil Co.) were mixed by stirring to prepare a powdery mixture. Then, an image-receiving sheet for an ink-jet recording was prepared by using the powdery mixture. In the same manner as in Example 6, the absorbency and color developing property of ink was examined. The results are shown in Table 2.

Example 9

Preparation of Powdery Coating Composition 80 parts of a styrene-acrylic copolymer resin (Himer Uni-3000, softening point: 98° C., manufactured by Sanyo Chemical Industry Co.) and 20 parts of fine particles of hydrophilic silica (Mizukasil P-527, average particle diameter: 1.6 μm, manufactured by Mizusawa Chemical Industry Co.) were melt-kneaded. After cooling, the resulting mixture was ground and classified to obtain a hydrophobic resin powdery coating composition having an average particle diameter of 11.0 μm. 100 parts of this hydrophobic resin powdery coating composition and 5 parts of fine particles of hydrophilic silica (200, average particle diameter: 12 nm, manufactured by Nippon Aerosil Co.) were mixed by stirring to obtain a powdery mixture.

Production of Image-receiving Sheet for an Ink-jet Recording

Using a commercially available electrostatic spray device, the above powdery mixture was sprayed on the entire surface of a commercially available ordinary paper and the powdery mixture was heated to about 80 to 100° C. under pressure, thereby to fix the powdery mixture to the ordinary paper. At the same time, particles of powdery coating composition were fused to each other, partially, to form a resin layer having a thickness of 20 μm, having a space between the particles of powdery coating composition, as an ink-receiving layer. Thus, an image-receiving sheet for an ink-jet recording was obtained.

Then, fine particles of hydrophilic silica (Aerosil 3.80, average particle diameter: 7 nm, manufactured by Nippon Aerosil Co.) were sprayed on this ink-receiving layer and the fine particles of hydrophilic silica were heated to about 80 to 100° C. under pressure, thereby to fix a surface layer having a thickness of 3 μm made of the particles of the hydrophilic silica on the ink-receiving layer, thus obtaining an image-receiving sheet for an ink-jet recording.

Ink-jet Recording Characteristics

Using a commercially available ink-jet printer (PM-750C, manufactured by Epson Co.), an ink-jet recording of the image-receiving sheet for an ink-jet recording was performed, and then the absorbency and color developing property of ink was examined. The absorbency of ink was examined as follows. A color chart defined by the Japanese Standards Society was ink-jet recorded on a recording paper and, immediately after recording, the image was touched by fingertip. The case where ink was not adhered to the fingertip was rated "good", while the case where ink was partially adhered to the fingertip was rated "poor". The color developing property of ink was examined by measuring the density of the most dense portion using a Macbeth densitometer (model RD-914). The results are shown in Table 2.

TABLE 2

| | Absorbency | Image Density | | | |
|---|---|---|---|---|---|
| | | Yellow | Magenta | Cyan | Black |
| Example | | | | | |
| 6 | Good | 1.10 | 1.13 | 0.61 | 1.49 |
| 7 | Good | 1.11 | 1.13 | 0.59 | 1.48 |

TABLE 2-continued

| | Absorbency | Image Density | | | |
|---|---|---|---|---|---|
| | | Yellow | Magenta | Cyan | Black |
| Comparative Example 4 | Poor | 0.80 | 0.83 | 0.40 | 1.11 |
| Example | | | | | |
| 8 | Good | 1.12 | 1.15 | 0.59 | 1.48 |
| 9 | Good | 1.20 | 1.19 | 0.65 | 1.49 |

Example 10

Preparation of Powdery Coating Composition and Powdery Mixture 100 parts of a styrene-acrylic copolymer resin (Himer Uni-3000, softening point: 98° C., manufactured by Sanyo Chemical Industry Co.) and 30 parts of polyethylene oxide polypropylene oxide (CP-2000 manufactured by Sumitomo Seika Co.) as a water-soluble resin were melt-kneaded in a double-screw melt-kneader at 150–160° C. for 4 minutes. After cooling, the resulting mixture was ground and classified to obtain a white powdery coating composition having an average particle diameter of 11.0 μm. 95 parts of this white powdery coating composition and 5 parts of hydrophilic anhydrous silica (Aerosil 200, average particle diameter: 12 nm, manufactured by Nippon Aerosil Co.) were mixed to obtain a white powdery mixture (proportion of anhydrous silica: 5%) for dry coating by an electrostatic spray method.

Production of Image-receiving Sheet for an Ink-jet Recording

Using a commercially available electrostatic spray device, the above white powdery mixture was adhered on the entire surface of a commercially available ordinary paper, followed by melting by heating and further fixing to form an image-receiving layer having a thickness of 20 μm, thus obtaining an image receiving sheet for ink-jet recording.

Ink-jet Recording Characteristics

Using a commercially available ink-jet printer (PM-750C, manufactured by Epson Co.), an ink-jet recording of the image-receiving sheet for an ink-jet recording was performed, and then the absorbency and color developing property of ink was examined. The absorbency of ink was examined as follows. A color chart defined by the Japanese Standards Society was ink-jet recorded on a recording paper and, immediately after recording, the image was touched by fingertip. The case where ink was not adhered to the fingertip was rated "good", while the case where ink was partially adhered to the fingertip was rated "poor". The color developing property of ink was examined by measuring the density of the most dense portion using a Macbeth densitometer (model RD-914). The results are shown in Table 3.

Example 11

In the same manner as in Example 10, except that polyvinyl alcohol (PVA-117, manufactured by Kuraray Co.) was used in place of polyethylene oxide polypropylene oxide as the water-soluble resin, a white powdery mixture (proportion of anhydrous silica: 5%) was prepared, and then an image-receiving sheet for an ink-jet recording having a receiving layer having a thickness of 20 μm on a commercially available ordinary paper was prepared by using the white powdery mixture. After ink-jet recording was performed, the absorbency and color developing property of ink was examined in the same manner as in Example 10. The results are shown in Table 3.

Example 12

In the same manner as in Example 10, except that hydroxylethylcellulose (AH-15, manufactured by Sumitomo Seika Co.) was used in place of polyethylene oxide polypropylene oxide as the water-soluble resin, a white powdery mixture (proportion of anhydrous silica: 5%) was prepared, and then an image-receiving sheet for an ink-jet recording having a receiving layer having a thickness of 20 μm on a commercially available ordinary paper was prepared by using the white powdery mixture. After ink-jet recording was performed, the absorbency and color developing property of ink was examined in the same manner as in Example 10. The results are shown in Table 3.

TABLE 3

| | | Image Density | | | |
|---|---|---|---|---|---|
| Example | Absorbency | Yellow | Magenta | Cyan | Black |
| 10 | Good | 1.14 | 1.17 | 0.63 | 1.52 |
| 11 | Good | 1.12 | 1.15 | 0.62 | 1.51 |
| 12 | Good | 1.13 | 1.16 | 0.62 | 1.50 |

What is claimed is:

1. A sheet comprising a substrate and a resin layer fixed on the substrate, wherein the resin layer is formed of particles of a resin containing powdery coating composition having an average particle diameter of 0.1 to 30 μm which are covered with inorganic fine particles having an average particle diameter of 1 nm to 1 μm heated and partially melted so that the particles of the partially melted powdery coating composition are fixed on the substrate as a continuous resin layer, with the inorganic fine particles intervening at least in part between the partially melted particles of powdery coating composition and providing space at least in part between the partially melted particles of powdery coating composition.

2. The sheet according to claim 1 wherein the powder coating composition further comprises a colorant.

3. The sheet according to claim 1 wherein the amount of the inorganic fine particles is within a range from 0.5 to 10% by weight based on the total amount of the powdery coating composition and the inorganic fine particles.

4. The sheet according to claim 1 wherein the inorganic fine particles are those of hydrophilic anhydrous silica, aluminum oxide, titanium dioxide or calcium carbonate.

5. The sheet according to claim 1 wherein the resin is a hydrophobic resin or a mixture of a hydrophobic resin and a hydrophilic resin.

6. The sheet according to claim 1 wherein the substrate is a paper.

7. An image-receiving sheet for an ink-jet recording comprising a sheet coated with a powdery coating composition in any one of claims 1 to 6.

8. An image-receiving sheet for use in ink-jet recording comprising a substrate and a resin layer fixed on the substrate and a surface layer fixed on the resin layer, wherein the resin layer is formed of particles of a resin containing powdery coating composition having an average particle diameter of 0.1 to 30 μm which are covered with first inorganic fine particles having an average particle diameter of 1 nm to 1 μm heated and partially melted so that the particles of the partially melted powdery coating composition are fixed on the substrate as a continuous resin layer with the first inorganic fine particles intervening at least in part between the particles of partially melted powdery coating composition and providing space at least in part between the particles of partially melted powdery coating composition, and the surface layer comprising second inorganic fine particles having an average particle diameter of 1 to 50 nm.

9. The image-receiving sheet according to claim 8 wherein the amount of the first inorganic fine particles is within a range from 0.5 to 10% by weight based on the total amount of the powdery coating composition and the first inorganic fine particles.

10. The image-receiving sheet according to claim 8 or 9 wherein the first inorganic fine particles are those of hydrophilic anhydrous silica, aluminum oxide, titanium dioxide or calcium carbonate.

11. The image-receiving sheet according to claim 8 wherein the second inorganic fine particles are those of hydrophilic anhydrous silica, aluminum oxide, titanium dioxide or calcium carbonate.

* * * * *